US009967642B2

(12) United States Patent
Yamaguchi et al.

(10) Patent No.: US 9,967,642 B2
(45) Date of Patent: May 8, 2018

(54) ELECTRONIC DEVICE

(71) Applicant: FUJITSU LIMITED, Kawasaki-shi, Kanagawa (JP)

(72) Inventors: Atsushi Yamaguchi, Kawasaki (JP); Daisuke Mihara, Kawasaki (JP); Tatsuya Fukushi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days. days.

(21) Appl. No.: 15/355,426

(22) Filed: Nov. 18, 2016

(65) Prior Publication Data

US 2017/0180839 A1 Jun. 22, 2017

(30) Foreign Application Priority Data

Dec. 21, 2015 (JP) ..... 2015-248271

(51) Int. Cl.

| | |
|---|---|
| ***H04R 1/02*** | (2006.01) |
| ***H04R 1/04*** | (2006.01) |
| ***H04R 1/28*** | (2006.01) |
| ***G10K 11/162*** | (2006.01) |
| ***H04R 1/08*** | (2006.01) |

(52) U.S. Cl.

CPC ..... *H04R 1/04* (2013.01); *G10K 11/162* (2013.01); *H04R 1/083* (2013.01); *H04R 1/086* (2013.01); *H04R 1/2869* (2013.01); *H04R 1/2876* (2013.01); *H04R 1/2892* (2013.01); *H04R 2201/003* (2013.01); *H04R 2410/07* (2013.01)

(58) Field of Classification Search

CPC ..... H04R 1/083; H04R 1/086; H04R 1/2807; H04R 1/2869; H04R 1/2876; H04R 1/38; H04R 19/04; H04R 2201/003; H04R 2410/07; H04R 1/04; H04R 1/2892; H04M 1/03; H04M 1/19; H04M 1/035

USPC ..... 381/91, 345, 353, 354, 355, 356, 357, 381/359, 360, 368, 174, 175; 181/151, 181/160; 379/392

See application file for complete search history.

(56) References Cited

U.S. PATENT DOCUMENTS

| | | | | |
|---|---|---|---|---|
| 4,449,236 | A * | 5/1984 | Walker, Jr. | H04M 1/03 379/392 |
| 4,858,719 | A * | 8/1989 | Fidi | H04R 1/38 181/158 |
| 7,496,208 | B2 * | 2/2009 | Uchimura | H04R 1/086 381/189 |
| 2008/0159578 | A1 | 7/2008 | Akino et al. | |
| 2012/0288130 | A1 * | 11/2012 | Dehe | H04R 19/04 381/353 |

FOREIGN PATENT DOCUMENTS

| | | |
|---|---|---|
| JP | 8-33084 | 2/1996 |
| JP | 2008-167175 | 7/2008 |

* cited by examiner

*Primary Examiner* — Huyen D Le
(74) *Attorney, Agent, or Firm* — Fujitsu Patent Center

(57) ABSTRACT

An electronic device includes: a case having an aperture; a board located within the case; a microphone located at a position corresponding to the aperture of the case; a partition wall located between the board and the case to surround a periphery of the microphone; and a sound absorbing material having a density of 46 kg/m$^3$ to 69 kg/m$^3$, and located in a space partitioned by the board, the partition wall, and the case to cover the microphone.

10 Claims, 8 Drawing Sheets

ELECTRONIC DEVICE

CROSS-REFERENCE TO RELATED APPLICATION

This application is based upon and claims the benefit of priority of the prior Japanese Patent Application No. 2015-248271, filed on Dec. 21, 2015, the entire contents of which are incorporated herein by reference.

FIELD

The embodiments discussed herein are related to an electronic device having a microphone.

BACKGROUND

Recently, a sound sensing technology is in the spotlight. When using such a sound sensing technology, for example, ambient sound may be detected with a microphone, and based on the detected result, for example, the state of a device, a person, or a pet such as a cat or a dog placed therearound may be detected.

Microphones used in the sound sensing technology require a wide dynamic range and a flat frequency characteristic. In addition, the outputs of the microphones are subjected to a signal processing in a calculation processing circuit such as, for example, a digital signal processor (DSP).

An example of a sound sensing microphone equipped in a personal device such as, for example, a portable phone or a personal computer, or a stationary state monitoring device, is a micro electro mechanical system (MEMS) microphone that employs a semiconductor manufacturing technology. The MEMS microphone in many cases is used by being directly attached to a wiring board.

It is assumed that a microphone is usually used in a state where no object is present therearound. The frequency characteristic of a single microphone is often relatively flat. However, when the microphone is accommodated in a case of a device, the frequency characteristic tends to be changed.

The followings are reference documents.

[Document 1] Japanese Laid-Open Patent Publication No. 2008-167175 and

[Document 2] Japanese Laid-Open Patent Publication No. 8-033084.

SUMMARY

According to an aspect of the invention, an electronic device includes: a case having an aperture; a board located within the case; a microphone located at a position corresponding to the aperture of the case; a partition wall located between the board and the case to surround a periphery of the microphone; and a sound absorbing material having a density of 46 kg/m3 to 69 kg/m3, and located in a space partitioned by the board, the partition wall, and the case to cover the microphone.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, prior to describing an exemplary embodiment, preliminary matters for easy understanding of the exemplary embodiment will be described.

Figure 1:
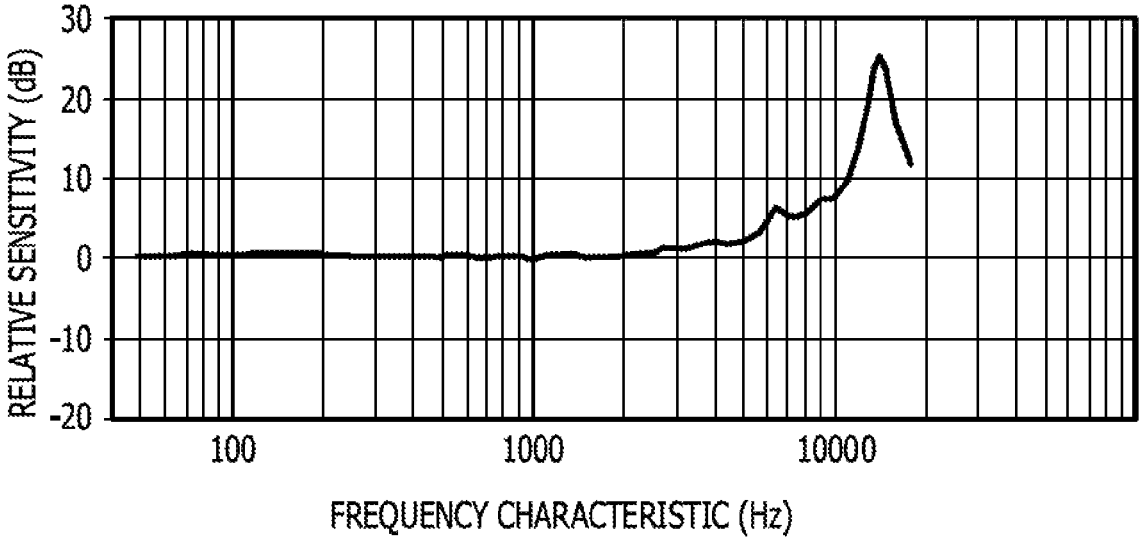
FIG. 1 is a view illustrating an exemplary frequency characteristic of an MEMS microphone.

FIG. 1 is a view illustrating an exemplary frequency characteristic of a MEMS microphone. In FIG. 1, the frequency characteristic in which the volume of 1 kHz is normalized as 0 dB is illustrated.

The sensitivity of a common MEMS microphone is in the range of about −20 dB/Pa to about −50 dB/Pa. For example, when a microphone having the frequency characteristic of FIG. 1 outputs a signal of −26 dB/Pa at 1 kHz, the sensitivity of the microphone at 1 kHz becomes −26 dB/Pa.

However, when analyzing the frequency of a signal input from the microphone, it is considered that an effective frequency may be determined generally up to 1/2.5 of a sampling frequency. Therefore, in the case of 16 kHz sampling which is common in, for example, a portable phone, an effective frequency may be determined up to about 6.4 kHz (=16 kHz/2.5).

Figure 2:
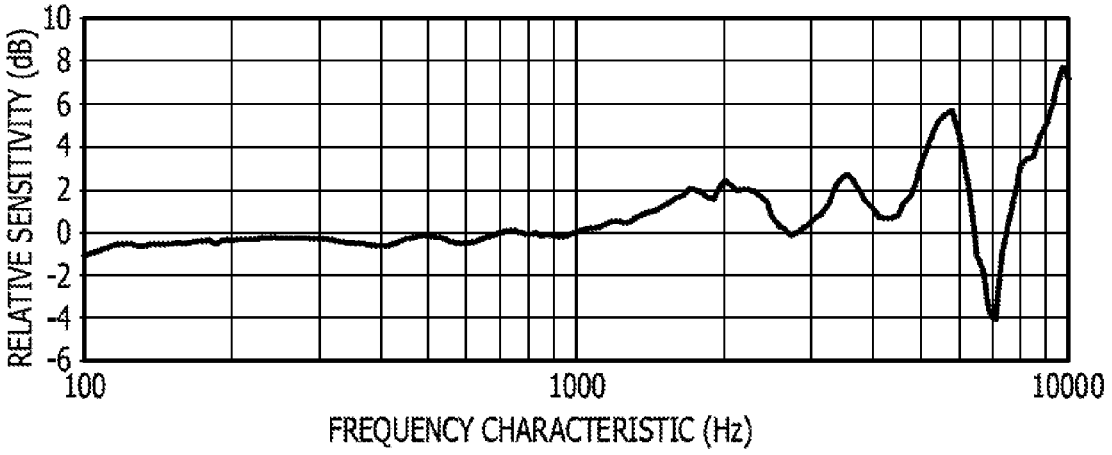
FIG. 2 is a view illustrating a result obtained by investigating a variation in frequency characteristic in a state where a microphone, which exhibits the frequency characteristic of FIG. 1, is directly attached to a wiring board.

As described above, the MEMS microphone is often used in a state of being directly attached to a wiring board. FIG. 2 is a view illustrating a result obtained by investigating a variation in frequency characteristic in a state where a microphone, which exhibits the frequency characteristic of FIG. 1, is directly attached to a wiring board.

When a microphone is attached to a plane, such as, for example, a wiring board, a resonance appears as illustrated in FIG. 2. In the example illustrated in FIG. 2, the difference between the maximum value and the minimum value of sensitivity is about 7 dB in the region of 6.4 kHz or less.

When there is a difference of about 7 dB when a DSP receives a signal from the microphone, it means that there is a difference of about 5 times (7 dB=$10^{(7/10)}$in detected sound pressure levels.

When representing the sound pressure level as a digital value, the numerical value may become double per 1 bit. Therefore, the DSP needs to perform an internal processing for 3 bits in order to equally handle data, which have a difference of about 5 times in detected sound pressure levels.

For this reason, in order to analyze a signal input from the microphone, bits of which the number is larger than the number of effective bits by 3 bits are required. For example, when using a 16-bit processing DSP, which currently prevails, the number of effect bits becomes 13 bits.

When detecting the state of, for example, a person, a device, or an animal with a sound sensing technology, it is requested that the sound sensing technology be capable of distinguishing sound from a high level to a low level and discriminating a loud sound and a soft sound simultaneously. To this end, it is important to maximize the number of effective bits in a calculation processing circuit of, for example, a DSP, in other words, to make the frequency characteristic of the microphone close to flat.

In the following exemplary embodiment, descriptions will be made on an electronic device that is able to improve the frequency characteristic of a microphone accommodated in a case thereof will be described.

(Exemplary Embodiment)

Figure 3:
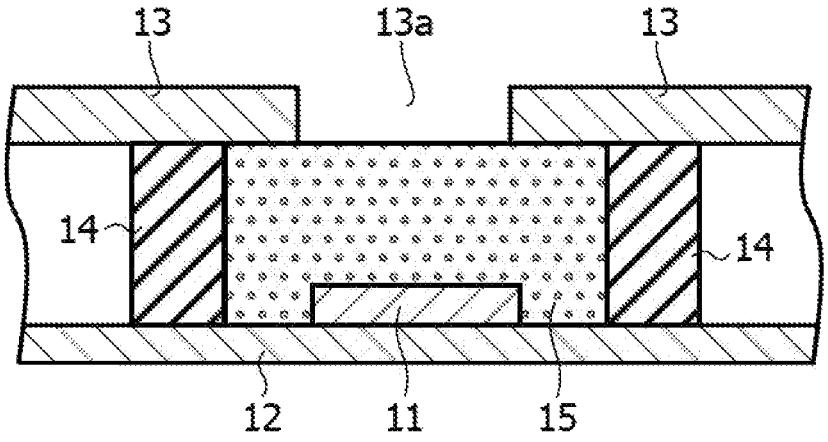
FIG. 3 is a sectional view illustrating a microphone attachment portion of an electronic device according to an exemplary embodiment.

FIG. 3 is a sectional view illustrating a microphone attachment portion of an electronic device according to an exemplary embodiment.

As illustrated in FIG. 3, a microphone 11 is mounted on a wiring board 12 and is accommodated in a case 13. An aperture (hereinafter referred to as "sound aperture") 13*a* for introducing sound into the case 13 is formed above the microphone 11. Meanwhile, the wiring board 12 is an example of a board.

The periphery of the microphone 11 is partitioned by a partition wall 14. In addition, the microphone 11 is covered with a sound absorbing material 15, which is located in the space partitioned by the wiring board 12, the case 13, and the partition wall 14.

Although the kind of the microphone 11 is not particularly limited, a MEMS microphone is used as the microphone 11 in the present exemplary embodiment.

The size of the microphone 11 is, for example, 3.76 mm in length, 4.72 mm in width, and 1.25 mm in height. In addition, the size of the space partitioned by the wiring board 12, the case 13, and the partition wall 14 is, for example, 13 mm in length, 13 mm in width, and 5 mm in height. In addition, the size of the sound aperture 13*a* is, for example, 5 mm in length and 5 mm in width.

In the present exemplary embodiment, a polyurethane sponge (polyurethane foam) is used as the sound absorbing material 15. The material of the sound absorbing material 15 is not limited to the above-mentioned one. However, the polyurethane sponge is suitable for flattening the frequency characteristic in which a large peak or valley is present in a high-frequency region as illustrated in FIG. 2 because the polyurethane sponge hardly absorbs low-frequency (1 kHz or less) sound and easily absorbs high-frequency sound.

Hereinafter, effects of the exemplary embodiment will be described.

Figure 4:
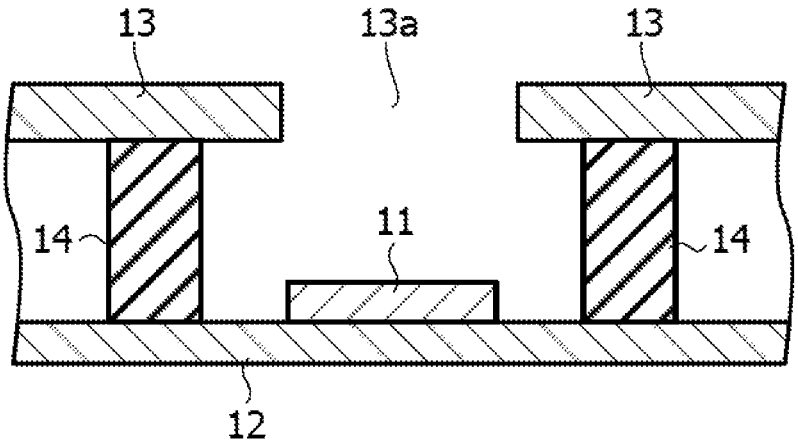
FIG. 4 is a sectional view illustrating an example of the microphone attachment portion on which no sound absorbing material is installed.

For example, when the partition wall 14 is installed as illustrated in FIG. 4 (i.e., when the sound absorbing material 15 of FIG. 3 does not exists), the space partitioned by the wiring board 12, the case 13, and the partition wall 14 acts as a Helmholtz resonator. In addition, the space causes the resonance of sound having a particular frequency depending on, for example, the area of an opening (the sound aperture 13*a*) or the volume of the space. Thereby, a large mountain or valley appears in the frequency characteristic of the microphone 11.

In the present exemplary embodiment, the sound absorbing material 15 covering the microphone 11 has a thickness of about 5 mm, and a sound absorbing effect by the sound absorbing material 15 having this level of thickness is small. However, the sound absorbing material 15 has a property to change a resonance characteristic of the space.

That is, in the present exemplary embodiment, the space in which the microphone 11 is located is made to have a desired resonance characteristic by installing the partition wall 14 around the microphone 11. In addition, the frequency characteristic of the microphone 11 accommodated in the case 13 is made to be close to flat by changing the resonance characteristic in the space using the sound absorbing material 15.

Figure 5:
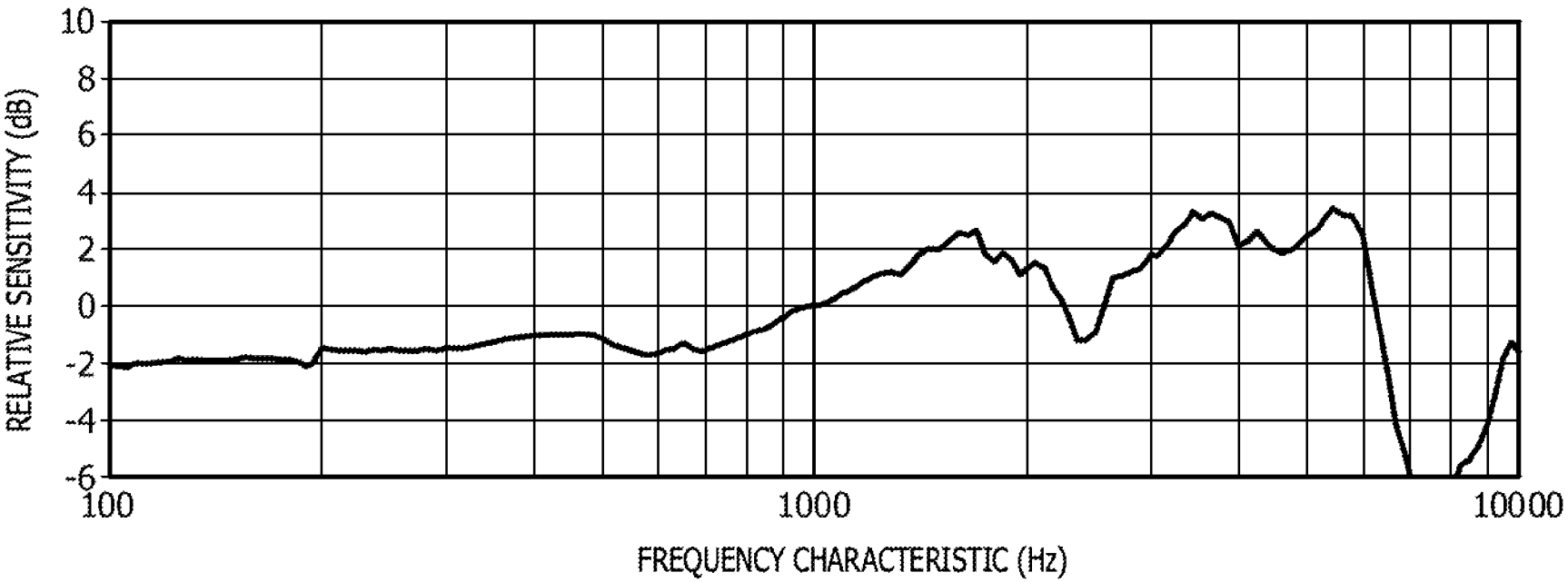
FIG. 5 is a view illustrating a result obtained by investigating a frequency characteristic when a polyurethane sponge having a density of 50 kg/m$^3$ is used as a sound absorbing material.

FIG. 5 is a view illustrating a result obtained by investigating a frequency characteristic when polyurethane sponge having the density of 50 kg/m$^3$ is used as the sound absorbing material 15. In the example illustrated in FIG. 5, the difference between the maximum value and the minimum value is 5 dB or less in the frequency region of 6.4 kHz. That is, the difference of a detected sound pressure level is about 3 times (5 dB=$10^{(5/10)}$), and a DSP performs an internal processing for 2 bits.

Assuming that the material of the sound absorbing material 15 is the same, the sound attenuation characteristic of the sound absorbing material 15 is concerned with the density of the sound absorbing material 15. The frequency characteristic of the microphone 11 (the frequency characteristic when the microphone 11 is accommodated in the case 13) may be flattened by appropriately adjusting the density of the sound absorbing material 15 according the resonance characteristic in the space in which the microphone 11 is accommodated.

In addition, as illustrated in FIG. 2, when the sound absorbing material 15 does not exists, the frequency characteristic of the microphone 11 is almost flat in the low-frequency region of 1 kHz or less. Here, the sensitivity in the low-frequency region is lowered when a heavy material, such as, for example, a metal or wool, is used as the sound absorbing material 15.

In addition, when a material having a wide-band sound absorbing characteristic such as, for example, glass or wool, is used as the sound absorbing material 15, the sensitivity is deteriorated in all frequency regions from a low-frequency region to a high-frequency region.

In the present exemplary embodiment, a material that less attenuates the sound of 1 kHz or less may be suitable for the sound absorbing material 15 because it is sufficient to eliminate the resonance in the space where the microphone 11 is accommodated. Therefore, for example, a light sponge formed of polyurethane or other resins may be used as the sound absorbing material 15.

Figure 6:
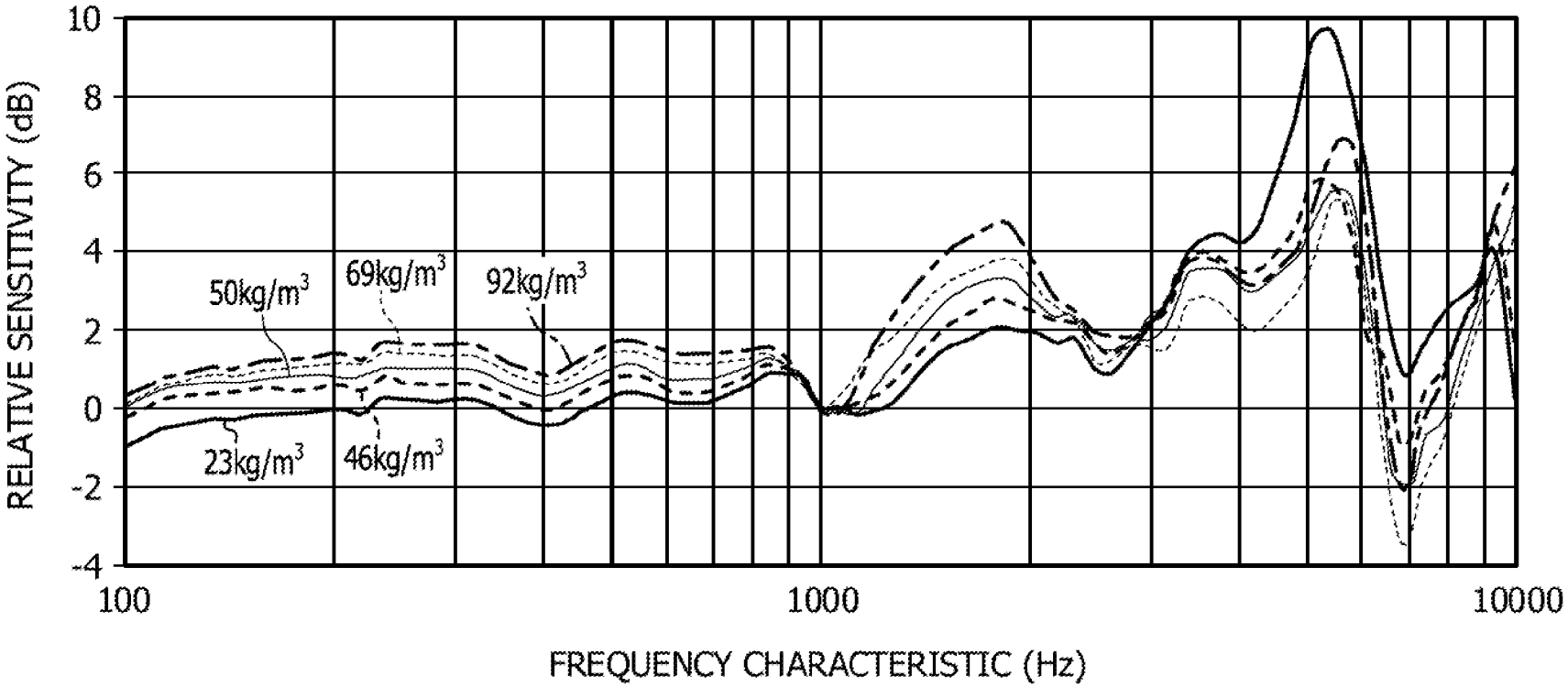
FIG. 6 is a view illustrating a result obtained by investigating a frequency characteristic while changing the density of the sound absorbing material.

FIG. 6 is a view illustrating a result by investigating a frequency characteristic while changing the density of the sound absorbing material 15.

Here, the size of the space for accommodating the microphone 11 is 13 mm in length, 13 mm in width, and 5 mm in height. In addition, the size of the sound aperture 13*a* is 5 mm in length and 5 mm in width.

In addition, EVERLIGHT VH™ (polyurethane foam) manufactured by Bridgestone Corporation was used as the sound absorbing material 15. Although the density of the sound absorbing material 15 is 23 kg/m$^3$ when the sound absorbing material is not compressed, sound absorbing materials 15 having densities of 46 kg/m$^3$, 50 kg/m$^3$, 69 kg/m$^3$, and 92 kg/m$^3$ were obtained by compressing the sound absorbing material 15.

As can be seen from FIG. 6, when the density of the sound absorbing material 15 is in the range of 46 kg/m$^3$ to 69 kg/m$^3$, the difference between the maximum value and the minimum value is always 6 dB or less. In this case, a DSP requires an internal processing for 2 bits in order to equally handle sound having a frequency of minimum sensitivity and sound having a frequency of maximum sensitivity.

Meanwhile, when the density of the sound absorbing material 15 is 23 kg/m$^3$ and when the density of the sound absorbing material 15 is 92 kg/m$^3$, the difference between the maximum value and the minimum value is always about 7 dB. In this case, a DSP requires an internal processing for 3 bits in order to equally handle sound having a frequency of minimum sensitivity and sound having a frequency of maximum sensitivity.

It can be seen from the above results that the density of the sound absorbing material 15 may be in the range of 46 kg/m$^3$ to 69 kg/m$^3$.

Because the thickness of the sound absorbing material 15 is 5 mm in the present exemplary embodiment, when the thickness is converted into a weight per 1 cm$^2$, the above numerical values become the range of 0.023 g/cm$^2$ to 0.035 g/cm$^2$. Thus, the thickness and the density of the sound absorbing material 15 may be determined so that the weight of the sound absorbing material 15 is in the range of 0.023 g to 0.035 g per 1 cm$^2$.

In addition, when the thickness of the sound absorbing material 15 exceeds 20 mm, the effect of attenuating sound is increased. Therefore, the thickness of the sound absorbing material 15 may be 20 mm or less.

Figure 7:
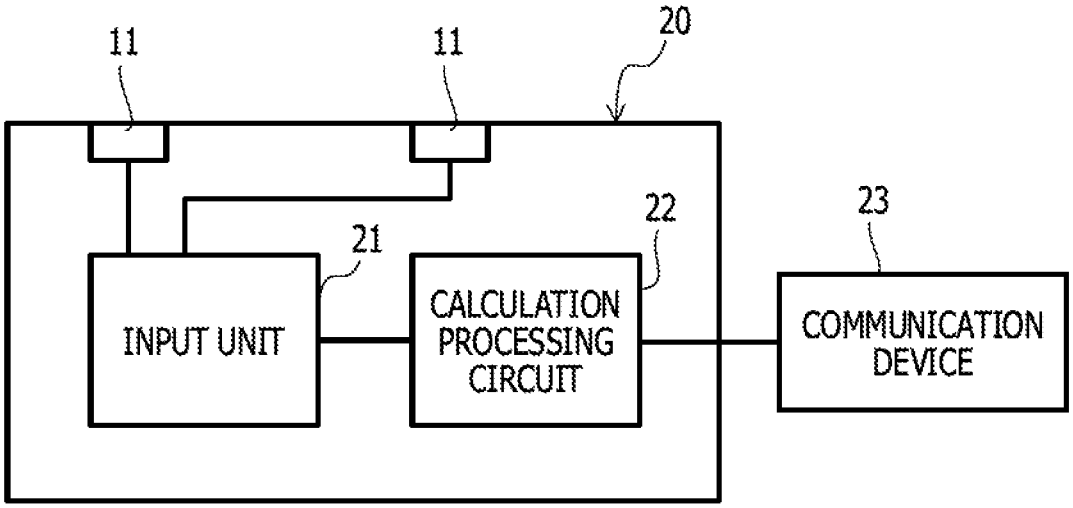
FIG. 7 is a block diagram illustrating an example of a stationary state monitoring device.
Figure 8:
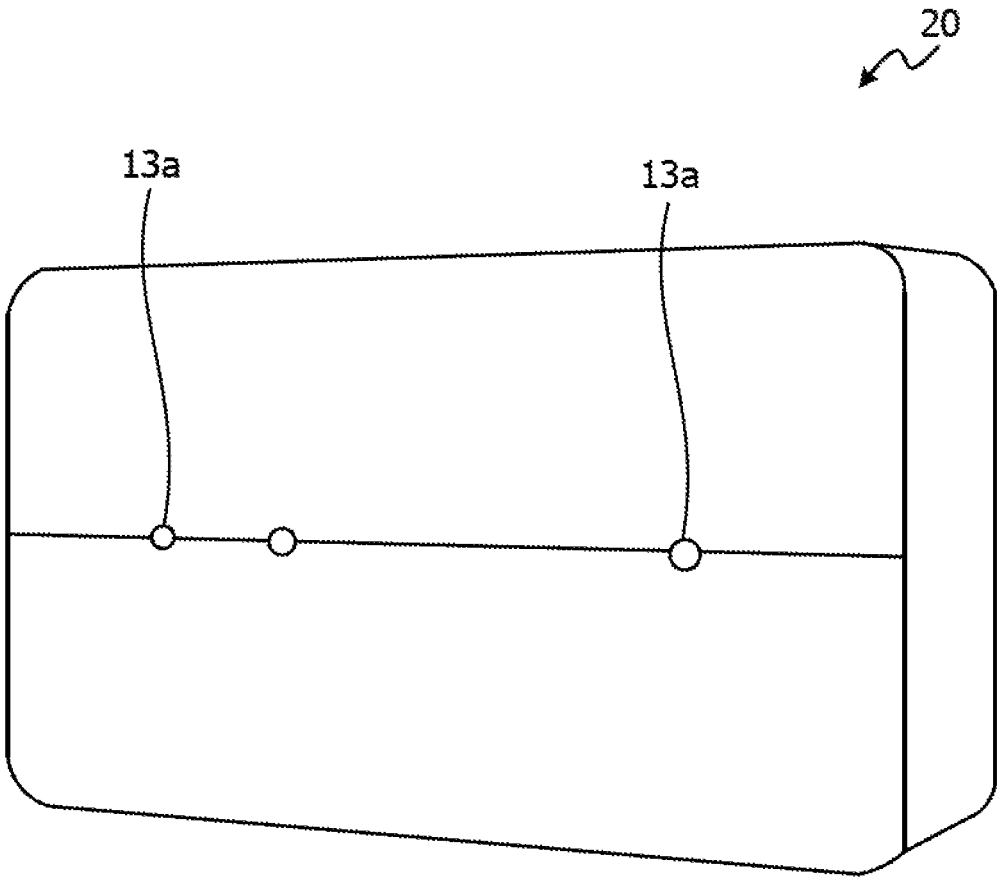
FIG. 8 is a perspective view illustrating the external appearance of the stationary state monitoring device.

FIG. 7 is a block diagram illustrating an example of a stationary state monitoring device, and FIG. 8 is a perspective view illustrating the external appearance of the stationary state monitoring device. Here, descriptions will be made on a device that is installed in a house of an elderly person who lives alone so as to monitor the state of the elderly person.

The stationary state monitoring device 20 illustrated in FIG. 7 includes two microphones 11, an input unit 21 configured to receive signals from the microphones 11, and a calculation processing circuit 22 configured to perform a signal processing on signals output from the input unit 21.

As illustrated in FIG. 8, the stationary state monitoring device 20 has sound apertures 13*a* formed in left and right sides of the front surface thereof, and the microphones 11 are located inside the sound apertures 13*a* (see, e.g., FIG. 3). Sound around the stationary state monitoring device 20 reaches the microphones 11 through the sound apertures 13*a*.

As illustrated in FIG. 3, the microphone 11 is directly attached to the wiring board 12, and is located in the space partitioned by the wiring board 12, the partition wall 14, and the case 13. In addition, the microphone 11 is covered with the sound absorbing material 15, which is formed of, for example, a polyurethane sponge having a thickness of 5 mm and a density of 50 kg/m$^3$.

The input unit 21 receives a signal output from the microphone 11 and outputs a digital signal. For example, when the microphone 11 is an analog microphone, the input unit 21 performs analog/digital (A/D) conversion on the signal output from the microphone 11 and outputs a digital signal. In addition, when the microphone 11 is a digital microphone, the input unit 21 performs 1 bit digital/digital (D/D) conversion on a signal output from the microphone 11 and outputs a digital signal.

The calculation processing circuit 22 is configured by, for example, a DSP. The calculation processing circuit 22 receives a signal from the input unit 21 and detects a sound pressure level at every frequency. Then, the detected result is transmitted to a predetermined data sensor (not illustrated) via a communication device 23.

The data sensor analyzes the signal transmitted from the stationary state monitoring device 20 and determines whether an abnormality is present. Then, upon determining that an abnormality is present, the data sensor notifies it to, for example, a preregistered family, hospital, or security company.

Although descriptions have been made on an example in which the technology disclosed herein is applied to the device for monitoring the state of an elderly person, the disclosed technology may be applied to various devices other than the device for monitoring the state of an elderly person.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to an illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. An electronic device comprising:
- a case having an aperture;
  - a board located within the case;
  - a microphone located at a position corresponding to the aperture of the case;
  - a partition wall located between the board and the case to surround a periphery of the microphone; and
  - a sound absorbing material having a density of 46 kg/m$^3$ to 69 kg/m$^3$, and located in a space partitioned by the board, the partition wall, and the case, the sound absorbing material covers all of an upper surface and all of a side surface of the microphone.

2. The electronic device according to claim 1, wherein the microphone is mounted on the board.

3. The electronic device according to claim 1, wherein the microphone is smaller than the space when viewed from the aperture side.

4. The electronic device according to claim 1, wherein the sound absorbing material is formed of a resin.

5. The electronic device according to claim 1, wherein the sound absorbing material has a thickness of 20 mm or less.

6. The electronic device according to claim 1, wherein the microphone is a micro electro mechanical system (MEMS) microphone.

7. The electronic device according to claim 1, further comprising:
- an input unit configured to input a signal thereto from the microphone to output a digital signal; and
- a calculation processing circuit configured to perform a signal processing on the digital signal output from the input unit to outwardly transmit the digital signal.

8. An electronic device comprising:
- a case having an aperture;
- a board located in the case;
- a microphone located at a position corresponding to the aperture of the case;
- a partition wall located between the board and the case to surround a periphery of the microphone; and
- a sound absorbing material having a weight from 0.023 g to 0.035 g per 1 cm$^2$, the sound absorbing material being located in a space partitioned by the board, the partition wall, and the case, the sound absorbing material covers all of an upper surface and all of a side surface of the microphone.

9. The electronic device according to claim 8, wherein the microphone is mounted on the board.

10. The electronic device according to claim 8, wherein the microphone is smaller than the space when viewed from the aperture side.

* * * * *